US007338228B2

(12) United States Patent
Ducroquet

(10) Patent No.: US 7,338,228 B2
(45) Date of Patent: Mar. 4, 2008

(54) APPLICATION DEVICE FOR LIQUID PRODUCT

(75) Inventor: Yves Ducroquet, Chaudon (FR)

(73) Assignee: Rexam Dispensing System S.A.S (FR)

( * ) Notice: Subject to any disclaimer, the term of this patent is extended or adjusted under 35 U.S.C. 154(b) by 0 days.

(21) Appl. No.: 11/295,047

(22) Filed: Dec. 6, 2005

(65) Prior Publication Data

US 2006/0140707 A1 Jun. 29, 2006

Related U.S. Application Data

(63) Continuation of application No. PCT/FR2004/001402, filed on Jun. 7, 2004.

(30) Foreign Application Priority Data

Jun. 6, 2003 (FR) ..... 03 06897

(51) Int. Cl.
*B05C 11/00* (2006.01)
*B43K 1/06* (2006.01)
*B43K 23/12* (2006.01)

(52) U.S. Cl. ..... 401/266; 401/265; 401/262

(58) Field of Classification Search ..... 401/198, 401/199, 202, 261, 262, 265, 266
See application file for complete search history.

(56) References Cited

U.S. PATENT DOCUMENTS 5,238,320 A * 8/1993 Komatsu et al. ..... 401/265
6,454,842 B1 * 9/2002 Vernardakis et al. ..... 106/31.02
6,572,297 B2 * 6/2003 Korper ..... 401/186
7,004,660 B2 * 2/2006 Kaempf ..... 401/202

FOREIGN PATENT DOCUMENTS

| | | |
|---|---|---|
| EP | 0 436 264 | 7/1991 |
| EP | 0 826 321 | 3/1998 |
| EP | 1 314 373 | 5/2003 |
| FR | 2 432 283 | 2/1980 |
| FR | 2 720 608 | 12/1995 |

OTHER PUBLICATIONS

International Search Report; Dec. 9, 2004; 5 pages.

* cited by examiner

*Primary Examiner*—David J. Walczak
(74) *Attorney, Agent, or Firm*—St. Onge Steward Johnston & Reens LLC

(57) ABSTRACT

An application device for a liquid product, contained in a reservoir bottle having a lid for closing the opening of the bottle, through which at least one capillary migration channel for the liquid product passes towards a wetable surface on contact therewith is provided. Several similar capillary channels are preferably provided, which can alternatively function as openings for the entry of air through the lid. One of the ends of each channel opens outside the lid. The other end opens in a collector tube for the liquid product, contained in the bottle. The collector tube is embodied to hold a fixed amount of liquid product against gravity by capillary action, until the above is drawn off by capillary migration through the lid channels.

15 Claims, 2 Drawing Sheets

APPLICATION DEVICE FOR LIQUID PRODUCT

CROSS-REFERENCE TO RELATED APPLICATIONS

This application is a continuation of International Patent Application No. PCT/FR2004/001402 filed on Jun. 7, 2004, which designates the United States and claims priority of French Patent Application No. 0306897 filed on Jun. 6, 2003.

FIELD OF THE INVENTION

The present invention relates to an applicator device used to check the distribution of a liquid product leaving a reservoir bottle. It finds a preferred although nonlimiting application in the packaging of high-cost liquids in small volumes, as is done in particular in the perfumery or pharmaceutical industry.

BACKGROUND OF THE INVENTION

The chemical, pharmaceutical and cosmetic industries market numerous liquid products which are packaged in various small bottles equipped with means for delivering the liquid product to the outside in a regulated way, in a single shot or in several shots spaced over time.

A particularly commonplace example of such various small bottles is that of bottles containing ophthalmic solutions. These bottles are equipped with dispensing adaptors in which a capillary duct constitutes a nozzle delivering the liquid one drop at a time. The expulsion of each drop is encouraged under the effect of gravity, either when the bottle is placed head down, or by the effect of a raised pressure exerted by hand by compressing the walls of the liquid reservoir. Patent application EP 0 436 264 describes an adaptor of this type, in an application to a vaccine. Therein it is explained how the end diameter of the capillary duct is determined to ensure that a drop of the desired volume is formed.

The present invention is aimed at designing an applicator device that is able to regulate a diffusion of liquid far more slowly than is achieved in dropping dispensers. The art illustrated in French patent application published under the number 2 720 608 cannot, however, be held up against the present invention. In that prior application, the device described is a portable device for diffusing scent which comprises, at the end of a capillary neck, a porous silica pellet the purpose of which is to allow the scent to escape to the open air not in the liquid state, but in the vapor state.

By contrast, the applicator device of the invention is designed to allow the liquid product, such as scent, to be distributed selectively when the applicator device is in contact with an appropriate wetable surface, through the effect of capillary migration of the product in the liquid state.

SUMMARY OF THE INVENTION

To this end, the subject of the invention is an applicator device as defined in the claims.

It will be understood that, according to the invention, use is made of the capillary phenomena in two different ways in the operation of one and the same device. Upstream, toward the reservoir bottle, the applicator device comprises a withdrawing tube which is advantageously in the form of a capillary duct such, particularly in terms of its diameter and its length, that it is capable, depending on the surface tension of the liquid with respect to its interior surface, of holding a determined dose of liquid without this dose dropping back into the reservoir, irrespective of the position of the assembly with respect to the direction of gravity. Downstream, toward the outside, the device comprises one or several capillary migration canals which advantageously consist of a few capillary holes through its lid and which are themselves so fine that they allow the liquid to pass only when a wetable material is brought into contact with the lid, thanks to a suction effect that is strong enough to overcome the capillary retaining forces which, in these capillary canals, oppose the flow of the liquid.

The withdrawing tube and the capillary canals differ in all the following respects: through their respective construction; through their relative arrangement; and through their functions. In the preferred embodiments of the device of the invention, a particularly simple method of construction is anticipated by producing the withdrawing tube and the capillary canals in a single piece, advantageously obtained by molding a plastic, which plugs the reservoir bottle in a sealed manner. As the constituent material is the same, it is then essentially in terms of their diameter by way of passage cross section offered to the liquid that the capillary canals differ from the withdrawing tube. Another advantageous difference between them is in regard to their length. The capillary canals are preferably relatively short, the lid in particular being relatively thin for this purpose. This eases the effect of migration when the liquid is attracted by the wetable surface brought into contact with the lid. The withdrawing tube for its part is long enough to accommodate the volume of a dose of liquid, namely of a drop.

In its preferred applications, the applicator device according to the invention is used to plug a reservoir containing a sample of scent. Scents and other eaux de toilette represent flagrant examples of expensive products that have not to be wasted, although in addition, in order to be effective, they need only be used in very small quantities. Furthermore, it has become customary to make small-capacity samples, corresponding to a few drops of scent, available to consumers so that they can test the scents given off under normal conditions of use when the scent is applied to their skin.

Between two applications of such a scent, for example when the bottle is reinverted just after an application, the withdrawing tube fills with a drop of liquid which remains captured therein through a capillary effect, and it is only when the lid of the device is applied to the skin that the scent passes through the capillary canals to be deposited on the user's skin. The same suction effect as the skin provides may occur, for example, upon contact with a textile material having more or less the same wetability properties, hence an obvious interest not only in scents for the body, but also in scented compositions used as room fresheners which, once thus absorbed on a textile material, will gradually diffuse into the atmosphere.

In other applications, the shapes and sizes of the withdrawing tube and those of the capillary canals will be chosen differently, to suit the liquid contained in the bottle and the nature of the material to which this liquid is to be applied. By way of examples, mention may be made of the case of an adhesive applied in a very thin layer or which has simply to impregnate very superficially a fabric that is to be bonded or that of a compound with a cosmetic or pharmaceutical action present in an aqueous or oil-based carrier, used by being applied to the skin.

According to a secondary characteristic recommended by the invention, a plurality, therefore at least two, capillary canals are provided, these being defined as such by their effectiveness with respect to the migration of the liquid through a lid of the reservoir bottle between a tube for withdrawing the liquid that by capillary effect holds a determined dose of liquid withdrawn from said reservoir against the forces of gravity and a wetable surface brought into contact with said lid such that said canals are able, alternately, to allow air to enter the bottle to replace the liquid consumed. The number of capillary canals is, in particular, five, each being able to act to release the liquid product by capillary migration from the withdrawing tube or as an air intake toward the reservoir of the bottle, either at the same time or, more generally, when the application in contact with the wetable surface has finished.

According to yet another advantageous feature of the invention in its preferred embodiments, the applicator device plugging a reservoir bottle is supplemented by a cap which covers the capillary migration canals. This makes it possible to prevent products from diffusing by evaporation between two periods of application to the wetable surface (the human skin in particular in the case of a bodily application). Furthermore, it is often useful to equip said cap with an absorbent pad made, for example, of plastic in the form of foam or sponge, which absorbs within it the last traces of liquid that may remain at the surface of the lid perforated with the capillary migration canals after an application to the wetable surface without, however, being able to act in the same way as this surface in terms of sucking the liquid against the capillary retention forces.

BRIEF DESCRIPTION OF THE DRAWINGS

The invention will now be described more fully in the context of preferred characteristics and of their advantages, with reference to FIGS. 1 to 5, in which.

DETAILED DESCRIPTION OF THE INVENTION

In the context of the embodiment chosen here, the invention is employed on a pocket-sized bottle containing from the outset a sample of scent. However, it will be understood that the embodiment of the device according to the invention are restricted neither to the dimensions that will be given hereinafter nor to the shapes illustrated as preferences in FIGS. 1 to 5 nor to the materials, the invention by contrast extending to cover any variant embodiment that remains within the scope of the protection afforded by the attached claims.

Figure 1:
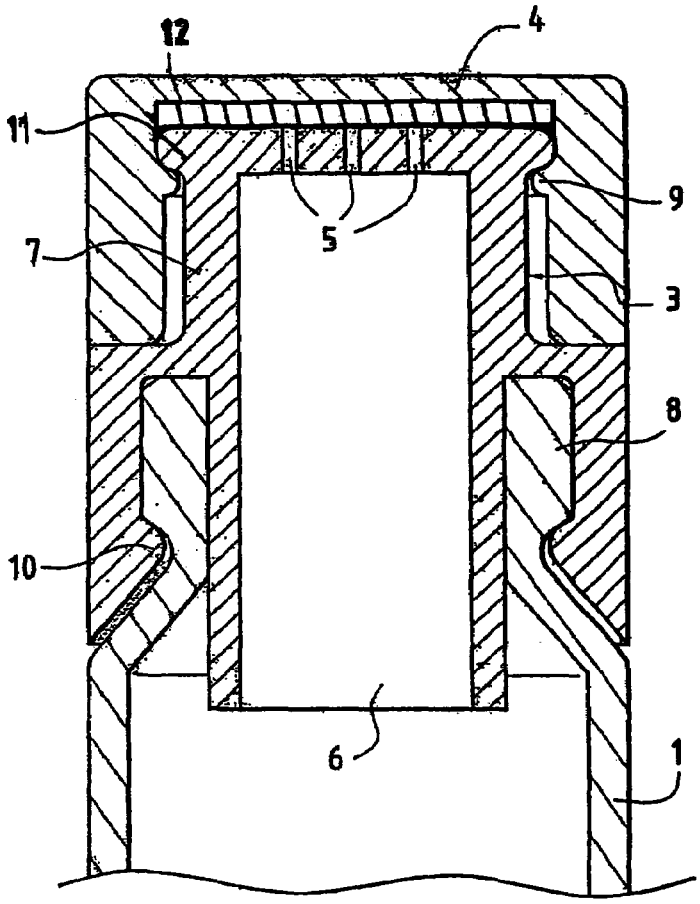
FIG. 1 is a view in section partially depicting a bottle forming a reservoir for a liquid product, at the point where this bottle is equipped with an applicator device according to one preferred embodiment of the invention, covered by a cap.
Figure 5:
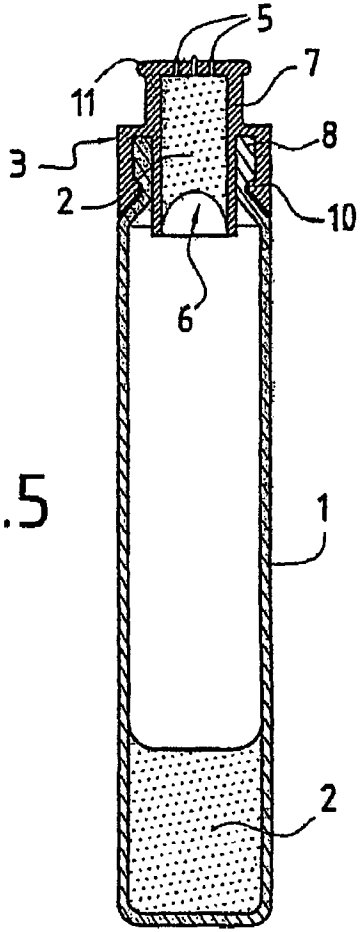
FIG. 5 is a view in section of the applicator device according to the invention placed on the bottle forming a reservoir, in a situation in which this bottle is in an upright vertical position, and in which the withdrawing tube is full of liquid held by capillary effect.
Figure 4:
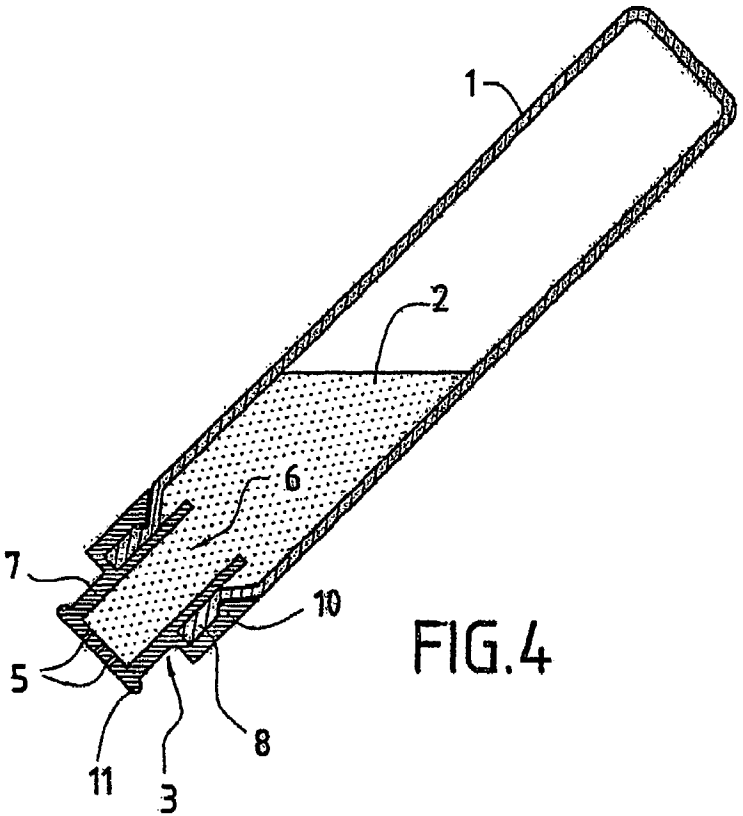
FIG. 4 is is a view in section showing the bottle equipped with the applicator device according to the invention as depicted in FIG. 3, in a situation in which it is in an inverted position.
Figure 3:
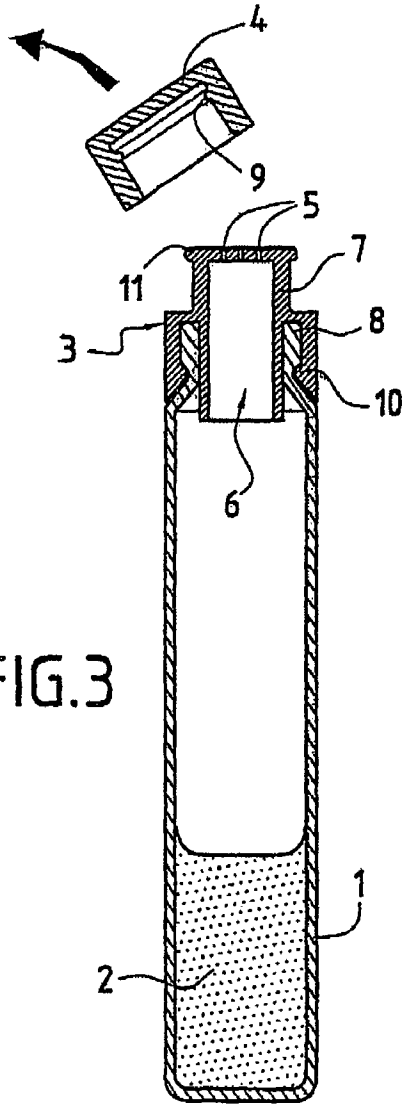
FIG. 3 depicts, in a view in section, a bottle equipped with the applicator device according to the invention including its cap, in a situation in which the bottle is in a vertical position, the liquid it contains being concentrated in the bottom, and in which the withdrawing tube of the applicator device is empty.

As is apparent in particular from FIG. 1 and from FIGS. 3 to 5, the applicator device 3 according to the invention is produced in the form of an adaptor which is mounted through the neck of a tube that constitutes a bottle 1, intended to contain a liquid product such as scent, illustrated as 2. This applicator device forms a lid 7 which covers the opening of the bottle.

In the example considered, the bottle 1 is made of a glass tube. It comprises a collar 8, formed as a protrusion beyond the exterior periphery of its neck around is opening. It is designed to allow the attachment of the adaptor or lid 7 to the bottle. The latter is in the form of a solid cylinder, stepped down to a hollow cylinder the interior wall of which is of a shape that compliments that of the collar 8. Between the hollow cylinder and an extension of the top solid cylinder, an annular space is formed in which the neck of the bottle fits. The lid 7 is held on the neck of the bottle 1 by the peripheral edge of the lid 7 at the base of the internal wall of the hollow cylinder part of the lid 7, which has an attachment bead 10 that fits into a complementary groove belonging to the bottle.

Figure 2:
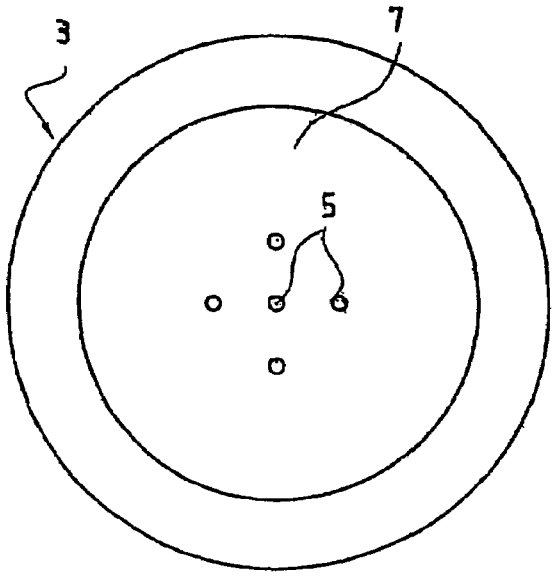
FIG. 2 is illustrates the applicator device according to the invention depicted in FIG. 1 in a view from above.

As shown by FIGS. 1 and 2, the top face of the lid 7 which closes the opening of the bottle is pierced with several capillary canals 5, in this instance five of them. These canals are open at their longitudinally opposed two ends. Toward the top in FIG. 1 they open to the outside of the device whereas toward the bottom they open into the internal cylinder of the applicator device, which, for the scent 2, forms a withdrawal tube 6 penetrating the top part of the bottle.

In the context of the concrete exemplary embodiment considered, the lid 7 and the withdrawing tube 6 are made as a single piece, advantageously of a polyolefin-based plastic. Polyethylene is generally preferred, although polypropylene may also be used. Manufacture can be done easily by injection-molding. The canals 5 may be produced by piercing the material once it has hardened. The material thus chosen has the advantage of being resistant to chemical attack and more readily wetted by the scent solutions than the material of which the bottle 1 is made can be when this bottle, as in the case described, is a simple glass tube externally having more or less the same diameter as the applicator device.

The withdrawing tube 6 has an inside diameter markedly smaller than the inside diameter of the bottle 1 so as to be able to hold and retain scent inside it through a capillary effect according to the invention. Its outside diameter is determined according to the inside diameter of the neck of the bottle 1 so that the two surfaces are in sealed contact with one another and so that the bottle is thus hermetically sealed at this point. In this way, external air can enter the bottle 1 only through the capillary canals 5. The latter are very fine. They do not allow the liquid to leave outside of the periods of use.

In the context of the particular embodiment chosen to illustrate the implementation of the invention, the withdrawing tube 6 has a diameter of 4 mm and a length of 12 mm, while the capillary canals have a diameter of 0.6 mm and a length of 1 mm (corresponding to the wall thickness of the top face of the end-fitting constituting the applicator device).

As illustrated by FIGS. 1 and 3, the applicator device 3 according to the invention is supplemented by a removable cap 4 which covers it, closing off the canals 5 outside of the periods of use of the bottle. According to the invention, the interior face of the cap 4 may also be covered with a fine layer of absorbent material, in organic resin foam for example. The purpose of this absorbent pad 12 is to mop the top film of scent that may remain flush with the outside of the lid 7 at the ends of the canals 5 after scent has been applied. Its effect, however, remains superficial, without continuing to suck and use up any scent that may remain available in the tube 6.

The cap 4 is designed to be fixed onto the end of the lid 7 rather than onto the bottle 1. To this end, the cap 4 internally has a shape that complements that of the lid 7, where there is a rim 11 formed projecting from the peripheral surface of the solid cylinder of the lid and a ring 9 formed projecting from the interior wall of the cap. Thus secure closure is ensured, minimizing the ingress of air that occurs when the cap 4 is removed and causes scent to pass too quickly through the capillary canals 5 of the lid 7, thereby causing product to be lost as the cap is removed.

It will also be noted from the figures that the cap 4 externally has the same diameter as the outer cylinder of the lid 7 and that this diameter is also substantially the same as that of the tube that forms the bottle 1.

Before the bottle equipped with the applicator device according to the invention is ever used, the withdrawing tube 6 needs to fill with scent, and this is obtained easily when the bottle is inverted, passing through a position like the one illustrated in FIG. 4. The scent remains held in the tube 6 by a capillary effect. The capillary forces are enough to withstand the force of gravity when the bottle is returned to an upright vertical position.

It is not until later when the transverse face of the lid 7 is applied to the human skin that a little scent is deposited there, because the skin is a wetable material. Being more wetable by the scent than is the material of which the applicator device is made, it tends to exert a suction effect which causes the scent to be transferred by capillary migration through the canals 5.

As soon as the applicator device is moved away from the surface of the skin, the attractive effect ceases and the capillary canals resume their role of closing off the tube 6, which keeps the unused remainder of the withdrawn scent. However, by virtue of the presence of at least two capillary canals, air enters the bottle 1 via one of them and reestablishes the pressure therein. This allows the product to be delivered continuously as long as contact with the skin or an equivalent material lasts. The pressure equalizing is also useful in allowing the withdrawing tube to refill from the mass of scent remaining in the bottle.

The foregoing description clearly explains how the invention makes it possible to achieve the objectives it set itself. However, the invention is not limited to that which is specifically described and depicted. In particular, the applicator device according to the invention may be fixed to other bottles containing, for example, cosmetic products such as liquid deodorants or makeup removal fluids. It may also be used on bottles containing products other than products to be applied to the body, for example bottles of adhesive. Furthermore, the same products may be applied to wetable materials that behave in a similar way to that which has been explained in the case of human skin, for example a textile fabric.

What is claimed is:

1. An applicator device for a liquid product contained in a reservoir bottle, said device comprising a lid for closing the opening of said bottle; at least one migration canal through said lid for the capillary migration of said liquid product to a wetable surface brought into contact therewith outside said bottle, a downstream end of said capillary migration canal opening to the outside of said lid; a withdrawal tube for withdrawing said liquid product from said bottle, in which an upstream end of said migration canal opens and that is constructed so as to retain a determined dose of liquid product withdrawn from said bottle against the action of gravity through a capillary effect; and a removable cap with a layer of material that is absorbent for the liquid on the outside of said lid but unable to absorb the liquid inside the at least one migration canal and the withdrawal tube.

2. The applicator device as claimed in claim 1, characterized in that said lid is pierced with at least two migration canals for capillary migration of said liquid product that are capable of acting alternately as air intake orifices through the lid.

3. The applicator device as claimed in claim 2, characterized in that said capillary migration canals have a diameter of 0.6 mm and a length of 1 mm, and in that said withdrawing tube has a diameter of 4 mm and a length of 12 mm.

4. The applicator device as claimed in claim 2, in which said canals are five in number.

5. The applicator device as claimed in claim 1, comprising several capillary migration canals that are determined in order alternately to act to equalize pressure by allowing air to enter said bottle.

6. The applicator device as claimed in claim 1, characterized in that said lid and said withdrawing tube are made of a single piece in a material relatively wetable by said liquid product compared to the bottle, and said lid is pierced with several said capillary migration canals that are fine in terms of diameter with respect to the diameter of said withdrawing tube.

7. The applicator device as claimed in claim 6, characterized in that said lid and said withdrawing tube are made of polyethylene or of polypropylene and in that said bottle is made of glass.

8. The applicator device as claimed in claim 1, characterized in that said removable cap presses against that face of the lid that is pierced with said capillary migration canal or canals.

9. The applicator device as claimed in claim 8, characterized in that said layer of material comes flush with the lid after the bottle has been in use.

10. The applicator device as claimed in claim 9, characterized in that said lid closing said bottle has substantially the same diameter as the bottle, as does also the cap.

11. The applicator device as claimed in claim 1, characterized in that said applicator device is made to apply a sample of scent onto a person's body.

12. The applicator device as claimed in claim 1, wherein said bottle contains a sample of scent for application through said lid across several capillary migration canals pierced therethrough onto a person's body constituting said wetable surface, said migration canals having a diameter such that they allow the liquid to pass when but only when said wetable material is brought into contact with the outside face of said lid, and wherein said withdrawal tube is constructed in terms of its diameter and its length so as to withdraw from the bottle a determined dose of said liquid and retain it against gravity whatever the position of the bottle may be.

13. An applicator device for a liquid product contained in a reservoir bottle, said device comprising a lid for closing the opening of said bottle; at least two migration canals having a diameter of 0.6 mm and a length of 1 mm through said lid for the capillary migration of said liquid product to a wetable surface brought into contact therewith outside said bottle and being capable of acting alternately as air intake orifices through the lid, a downstream end of said capillary migration canal opening to the outside of said lid; and a withdrawal tube having a diameter of 4 mm and a length of 12 mm for withdrawing said liquid product from said bottle, in which an upstream end of said migration canal opens and that is constructed so as to retain a determined dose of liquid product withdrawn from said bottle against the action of gravity through a capillary effect, said application device further comprising a removable cap covered on its interior surface with a layer of material that is absorbent for the liguid on the outside of the lid but unable to absorb the liguid inside the at least one migration canal and the withdrawal tube.

14. The applicator device as claimed in claim 1, characterized in that said lid has externally substantially the same diameter as the bottle on which said applicator device is installed, as does also said removable cap.

15. An applicator device for a liquid product comprising a reservoir bottle having a neck and an opening, a lid connected to the reservoir bottle for closing the opening of said bottle, at least one migration canal through said lid for the capillary migration of said liquid product to a wetable surface brought into contact therewith outside said bottle, a downstream end of said at least one capillary migration canal opening to the outside of said lid, and a withdrawal tube for withdrawing said liquid product from said bottle, in which an upstream end of said at least one migration canal opens, said withdrawal tube and said lid being formed as a single piece, and wherein said withdrawal tube has an inside diameter markedly smaller than the inside diameter of the bottle and an outside diameter selected to come into sealed contact with the neck of said bottle and constructed so as to retain a determined dose of liquid product withdrawn from said bottle against the action of gravity through a capillary effect, said application device further comprising a removable cap with a layer of material that is absorbent for the liquid on the outside of the lid but unable to absorb the liquid inside the at least one migration canal and the withdrawal tube.

* * * * *